US009168557B2

(12) United States Patent
Saeki et al.

(10) Patent No.: US 9,168,557 B2
(45) Date of Patent: Oct. 27, 2015

(54) COATING APPARATUS

(75) Inventors: Tatuya Saeki, Yokohama (JP); Hiroaki Kobayashi, Yokohama (JP); Yasushi Shinjo, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 268 days.

(21) Appl. No.: 13/613,341

(22) Filed: Sep. 13, 2012

(65) Prior Publication Data

US 2013/0074766 A1 Mar. 28, 2013

(30) Foreign Application Priority Data

Sep. 26, 2011 (JP) ..... 2011-209099

(51) Int. Cl.

| | |
|---|---|
| ***B05C 1/00*** | (2006.01) |
| ***B05C 3/02*** | (2006.01) |
| ***B05C 11/10*** | (2006.01) |
| ***B05C 1/08*** | (2006.01) |

(52) U.S. Cl.

CPC ..... *B05C 1/0886* (2013.01); *B05C 1/0813* (2013.01)

(58) Field of Classification Search

USPC ..... 118/244, 401, 419, 429, 238, 256, 712, 118/246, 252, 258–262, 663, 679, 687; 427/294, 299, 314, 345, 428.18, 429, 427/560

See application file for complete search history.

(56) References Cited

U.S. PATENT DOCUMENTS

| | | | | |
|---|---|---|---|---|
| 3,756,196 | A * | 9/1973 | Furuuchi et al. | 118/401 |
| 4,167,916 | A * | 9/1979 | Pierce | 118/212 |
| 4,370,356 | A | 1/1983 | Bok et al. | |
| 5,688,324 | A * | 11/1997 | Umaba | 118/401 |

FOREIGN PATENT DOCUMENTS

| | | |
|---|---|---|
| JP | 6-206027 | 7/1994 |
| JP | 2004-164873 | 6/2004 |
| JP | 2009-50811 | 3/2009 |

* cited by examiner

*Primary Examiner* — Yewebdar Tadesse

(74) *Attorney, Agent, or Firm* — Oblon, McClelland, Maier & Neustadt, L.L.P.

(57) ABSTRACT

Certain embodiments provided a coating apparatus includes an applicator, material supply unit, and first, second, and third moving mechanisms. The applicator includes a meniscus pillar forming portion configured to form a meniscus pillar of the material in conjunction with a surface to be coated of the object to be coated and a recess. The material supply unit supplies the material to the applicator. The first moving mechanism moves the position of the applicator relative to the surface along the surface. The second moving mechanism moves the position of the applicator relative to the surface so that the meniscus pillar between the surface and the recess. The third moving mechanism moves the position of the applicator relatively toward and away from the surface.

13 Claims, 13 Drawing Sheets

COATING APPARATUS

CROSS-REFERENCE TO RELATED APPLICATIONS

This application is based upon and claims the benefit of priority from Japanese Patent Application No. 2011-209099, filed Sep. 26, 2011, the entire contents of which are incorporated herein by reference.

FIELD

Embodiments described herein relate generally to a coating apparatus configured to apply a material to an object to be coated.

BACKGROUND

A meniscus coating method is a method of applying a liquid material to an object to be coated, such as a substrate, thereby forming a film. In a coating apparatus based on the meniscus coating method, a meniscus pillar of the material is formed between an applicator and a surface to be coated of the object to be coated to which the material is applied. In this state, the surface to be coated and applicator are moved relatively along the plane of the surface to be coated. In this way, the meniscus Pillar moves relatively on the surface to be coated, whereupon the material is applied to the surface to be coated.

DETAILED DESCRIPTION

Certain embodiments provided a coating apparatus comprising an applicator, material supply unit, and first, second, and third moving mechanisms.

The applicator includes a meniscus Pillar forming portion configured to form a meniscus pillar of the material in conjunction with a surface to be coated of the object to be coated and a recess formed in a position different from that of the meniscus Pillar forming portion and recessed relative to the surroundings thereof. The material supply unit supplies the material to the applicator. The first moving mechanism moves the position of the applicator relative to the surface to be coated along the surface to be coated. The second moving mechanism moves the position of the applicator relative to the surface to be coated so that the meniscus Pillar, which is formed between the meniscus Pillar forming portion and the surface to be coated, between the surface to be coated and the recess. The third moving mechanism moves the position of the applicator relatively toward and away from the surface to be coated.

Figure 1:
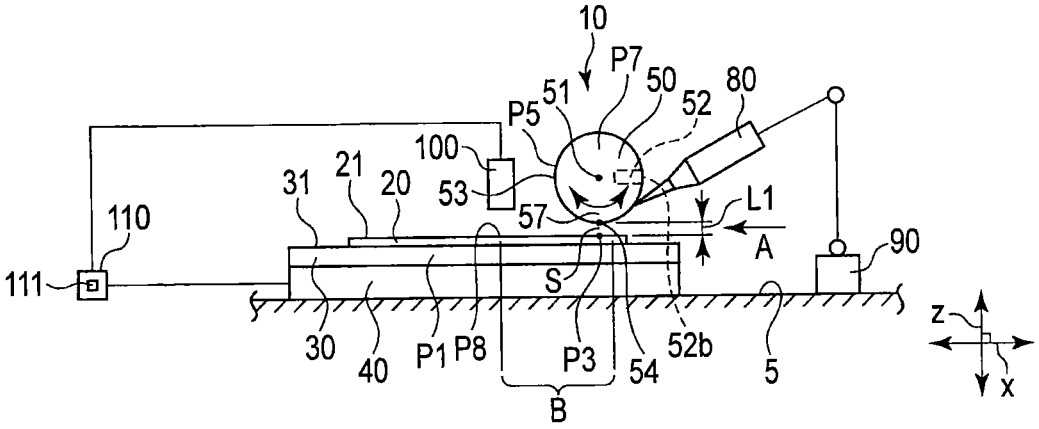
FIG. 1 is a front view showing a coating apparatus according to a first embodiment.
Figure 2:
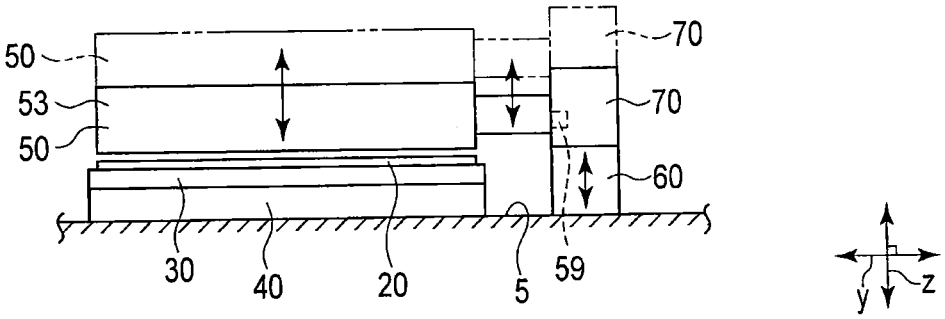
FIG. 2 is a side view of the coating apparatus taken in the direction of arrow A in FIG. 1.

A coating apparatus according to a first embodiment will now be described with reference to FIGS. 1 to 9. FIG. 1 is a front view schematically showing a coating apparatus 10. FIG. 2 is a side view of the coating apparatus 10 taken in the direction of arrow A in FIG. 1. The coating apparatus 10 applies a liquid material M to a surface 21 of a substrate 20, thereby forming a film on the surface 21. The surface 21 is a surface to be coated of the substrate 20 to which the material M is applied.

As shown in FIGS. 1 and 2, the coating apparatus 10 comprises a substrate stage 30, stage moving device 40, applicator 50, z-axis applicator moving device 60, applicator pivoting device 70, material supply unit 80, material supply unit moving device 90, sensor 100, and control unit 110. The applicator pivoting device 70 serves to pivot the applicator 50. The material supply unit 80 supplies the material M to the applicator 50.

To "pivot the applicator 50", as stated herein, is to rotate the applicator 50 through a predetermined angular range about its axis 51. In the present embodiment, the predetermined angular range is a range between an application rotational position P5 and material recovery rotational position P6, which will be described later. In the description of each embodiment of the present invention to follow, to "pivot the applicator" is to pivot the applicator through the predetermined angular range between the application rotational position P5 and material recovery rotational position P6.

The stage moving device 40 is secured to a fixed surface 5. The fixed surface 5 is, for example, the surface of a factory floor on which the coating apparatus 10 is located. The stage moving device 40 comprises a coordinate space defined by x-, y-, and z-axes. As shown in FIGS. 1 and 2, the x- to z-axes extend perpendicular to one another. In the present embodiment, the z-axis extends parallel to a direction where the gravity acts, for example. In other words, the z-axis extends vertically.

The substrate stage 30 is disposed on the stage moving device 40 for movement along the x-axis. The stage moving device 40 moves the substrate stage 30 along the x-axis under the control of the control unit 110, which will be described later. A top surface 31 of the substrate stage 30 is, for example, a flat surface perpendicular to the z-axis. A fixing portion configured to secure the substrate 20 to the top surface 31 is provided at the upper part of the substrate stage. For example, the fixing portion has the function of securing the substrate 20 to the top surface 31 by means of a suction force. Alternatively, the fixing portion may be configured to have the function of securing the substrate 20 to the top surface 31 in a clamped manner. When the substrate 20 is on the substrate stage 30, the surface 21 is a flat surface perpendicular to the z-axis.

A substrate-stage reference position is set for the substrate stage 30. The substrate stage 30 is in the substrate-stage reference position relative to the origin of the xyz-coordinate space.

As shown in FIGS. 1 and 2, the applicator 50 is in the form of a circular column having a circular shape along the axis 51. Further, a cross-section perpendicular to the axis of the applicator 50 is also circular, so that the same shape is maintained along the axis 51. The applicator 50 is disposed in such an orientation that the axis 51 extends parallel to the y-axis.

Figure 3:
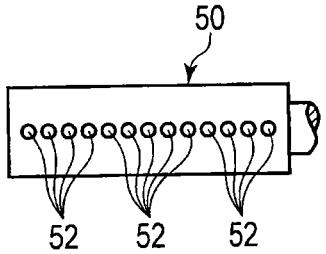
FIG. 3 is a side view of an applicator shown in FIG. 1, taken from one direction, showing a surface of the applicator.

FIG. 3 shows the surface of the applicator 50 as viewed from one direction. As shown in FIG. 3, the applicator 50 is formed with a plurality of holes 52. One of the holes 52 is indicated by a dotted line in FIG. 1. As shown in FIG. 1, each hole 52 is recessed inwardly relative to the applicator 50 and opens in a surface 53 of the applicator 50.

The holes 52 are arranged parallel to one another along the axis 51, that is, the y-axis, in the surface 53 of the applicator 50. All the holes 52 have the same shape. The holes 52 are arranged at regular intervals from near one end to near the other end of the applicator 50.

The applicator pivoting device 70 supports the applicator 50 for pivoting motion about the axis 51. The axis 51 is the axis of rotation of the applicator 50. The applicator pivoting device 70 is provided on the z-axis applicator moving device 60.

The z-axis applicator moving device 60 is secured to the fixed surface 5. The applicator moving device 60 can move the applicator pivoting device 70 along the z-axis while maintaining the orientation where the axis 51 of the applicator 50 extends parallel to the y-axis. Accordingly, the applicator 50 is moved along the z-axis. In other words, the applicator moving device 60 can move the applicator 50 toward and away from the surface 21 of the substrate 20 while maintaining the orientation where the axis 51 extends parallel to the y-axis. In FIG. 2, two-dot chain lines indicate the applicator 50 and applicator pivoting device 70 having moved along the z-axis.

As the z-axis applicator moving device 60 is secured to the fixed surface 5 in this manner, the applicator 50 is movable only along the z-axis and not along the x- and y-axes. Thus, the position of the applicator 50 relative to the substrate stage 30 along the x-axis changes as the substrate stage 30 moves relative to the applicator 50 along the x-axis. This is an example of the way the position of the applicator 50 relative to the surface to be coated is moved relatively along the surface to be coated. The position of the applicator 50 along the z-axis is the position of the axis 51 of the applicator.

The material supply unit 80 introduces the material M onto the surface 53 of the applicator 50. The material M is a liquid. The material supply unit moving device 90 serves to move the position of the material supply unit 80. FIG. 1 shows the position of the material supply unit 80 where it introduces the material M onto the surface 53 of the applicator 50.

The sensor 100 detects the z-coordinate of the surface 21 of the substrate 20 in a preset predetermined position, that is, in a predetermined xy-coordinate. In the present embodiment, the position of the sensor 100 is fixed relative to the fixed surface 5 and is immovable. Thus, the xyz-coordinate indicative of the position of the sensor 100 is constant and fixed.

As the substrate stage 30 moves, the position of the sensor 100 relative to the stage 30 changes. The sensor 100 detects the z-coordinate of the position of the surface 21 of the substrate 20 that faces the sensor 100 along the z-axis. For example, the sensor 100 irradiates a laser beam toward the surface 21 of the substrate 20 and detects its reflected beam, thereby detecting the z-coordinate of the position of the surface 21 that faces the sensor 100 along the z-axis. The sensor 100 transmits the result of the detection to the control unit 110, which will be described later.

A movement of the substrate stage 30 with the sensor 100 fixed thereon is an example of a change of the sensor position relative to the surface to be coated. For example, the z-coordinate of each position of the surface to be coated of the substrate 20 may be detected with the substrate stage 30 secured to the fixed surface 5 and with the sensor 100 disposed for movement along the x- and y-axes.

Thus, in the present embodiment, the z-coordinate of the position of the surface 21 that faces the sensor 100 along the z-axis is typically detected. Based on the detected z-coordinate, control is performed such that the distance between the surface 21 and applicator 50 along the z-axis is fixed.

If the applicator 50 is distorted or if the horizontally of the applicator 50 relative to the surface 21 of the substrate 20 is insufficient, the distance between the applicator 50 and substrate surface 21 may be controlled, as required, in consideration of the x-axis direction where the applicator 50 advances and the y-axis direction where the applicator extends. In this case, the coating apparatus 10 comprises a mechanism capable of changing the orientation of the substrate 20 so that the surface 21 is inclined relative to the z-axis.

The control unit 110 ascertains the z-coordinate of the surface 21 of the substrate 20 on receiving the result of the detection from the sensor 100. Further, the control unit 110 controls the stage moving device 40, z-axis applicator moving device 60, applicator pivoting device 70, material supply unit moving device 90, material supply unit 80, and sensor 100.

The control unit 110 comprises a storage unit 111. A schedule of operations performed by the control unit 110 is set in the storage unit 111. The storage unit 111 is activated according to the operation schedule set in the storage unit 111. An operator can input this operation schedule to the storage unit 111 by means of an operating unit.

Specifically, the storage unit 111 has x-coordinate data on an application start position P1 of the substrate stage 30 where application of the material M to the surface 21 of the substrate 20 is started and z-coordinate data on an application start position P7 of the applicator 50. The application start position P1 is a reference position of the substrate stage 30. The position of the applicator 50 is the position of the axis 51 of the applicator. Further, the storage unit 111 has x-coordinate data on an application end position P2 of the substrate stage 30 where the application of the material M to the surface 21 of the substrate 20 is terminated.

As described above, the coating apparatus 10 uses a meniscus coating system. The application start position P7 of the applicator 50 is a position where the distance of a gap S between a lowermost end 54 of the applicator 50 and the surface 21 of the substrate 20 along the z-axis is a first predetermined distance L1 for the formation of a predetermined meniscus pillar P. The predetermined meniscus pillar P is a meniscus pillar the shape of which is predetermined for the application of the material M.

If the substrate stage 30 is in the application start position P1, then the x-coordinate of one x-direction end of the meniscus pillar P formed between the applicator 50 and the surface 21 of the substrate 20 corresponds to the x-coordinate position of one end of the film to be formed. If the substrate stage 30 is in the application end position P2, then the x-coordinate of the other x-direction end of the meniscus pillar P formed between the applicator 50 and the surface 21 of the substrate 20 corresponds to the x-coordinate position of the other end of the film to be formed.

To apply the material M to the surface 21 of the substrate 20, the meniscus pillar P is formed with a predetermined width along the x-axis. The meniscus pillar P has a regular shape along the y-axis. The width of the meniscus pillar P along the x-axis depends on the position of the applicator 50 relative to the surface 21 of the substrate 20. To form the meniscus pillar P with the predetermined width along the x-axis, therefore, the position of the applicator 50 relative to the surface 21 of the substrate 20 along the z-axis is preset. The width of the meniscus pillar P along the x-axis can be obtained in advance by an experiment or the like. The meniscus pillar P extends parallel to the z-axis.

According to the present embodiment, the shape of the cross-section of the applicator 50 perpendicular to the axis 51, as viewed along the axis 51, is circular, so that the shape of the meniscus pillar P along the x-axis is symmetrical with respect to the z-axis. In the present embodiment, the substrate stage 30 is in the application start position P1 when the lowermost end 54 of the applicator 50 along the z-axis faces a first position P3 set on the surface 21 of the substrate 20 along the z-axis, as shown in FIG. 1. The substrate stage 30 is in the application end position P2 when the lowermost end 54 of the applicator 50 faces a second position P4 set on the surface 21 along the z-axis.

Further, the storage unit 111 has data on the speed of movement of the substrate stage 30 from the application start position P1 to the application end position P2. The z-direction thickness of the material M applied to the surface 21 of the substrate 20 changes depending on the speed of movement of the applicator 50 relative to the substrate 20. The control unit 110 has data on the movement speed of the substrate stage 30 based on the thickness of the film to be formed. In the present embodiment, the movement speed is constant.

Furthermore, the storage unit 111 has xyz-coordinate data on a material supply position of the material supply unit 80 that introduces the material M onto the surface 53 of the applicator 50. When the material M is supplied to the applicator 50, the control unit 110 controls the material supply unit moving device 90 to move a reference position set in the material supply unit 80 to the material supply position.

Further, the storage unit 111 has data on the application rotational position P5 and material recovery rotational position P6 of the applicator 50. The application rotational position P5 is a rotational position where the meniscus pillar P is formed between the applicator 50 and the surface 21 of the substrate 20. In this rotational position, that portion of the applicator 50 which is not formed with the holes 52 face the surface 21 of the substrate 20 along the z-axis. In the present embodiment, a part of the recess-free portion is provided as a meniscus pillar forming portion 57. When the applicator 50 is in the application rotational position P5, the meniscus pillar forming portion 57 is located opposite the surface 21 of the substrate 20 along the z-axis. The material recovery rotational position P6 is a rotational position where the holes 52 face the surface 21 of the substrate 20 along the z-axis.

Figure 4:
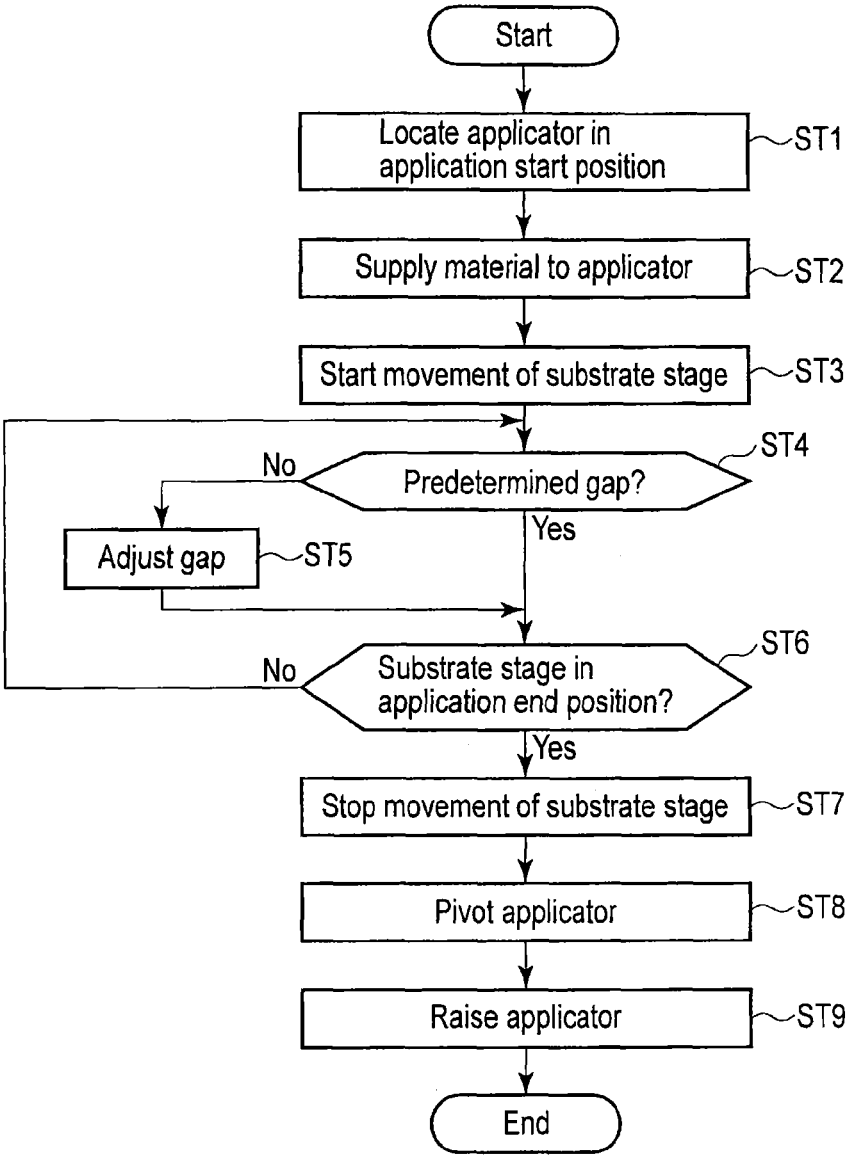
FIG. 4 is a flowchart illustrating the operation of a control unit shown in FIG. 1.

The following is a description of the operation of the coating apparatus 10. FIG. 4 is a flowchart illustrating the operation of the control unit 110. If the operator turns on an operation start switch for starting a coating operation by the coating apparatus 10, for example, the apparatus 10 is enabled to operate, whereupon the control unit 110 starts its operation, as shown in FIG. 4. Before the coating apparatus 10 actually starts the operation for applying the material M, the operation schedule and various coordinate data are input to the storage unit 111 of the control unit 110.

When the start switch for the coating operation by the coating apparatus 10 is turned on, the program proceeds to Step ST1. In Step ST1, the control unit 110 controls the stage moving device 40 to move the substrate stage 30 to the application start position P1. Also, the control unit 110 controls the z-axis applicator moving device 60 to move the applicator 50 to the application start position P7.

Further, the control unit 110 controls the applicator pivoting device 70 to pivot the applicator 50 to the application rotational position P5. In this way, the applicator 50 takes the position and orientation relative to the surface 21 of the substrate 20 where it starts application of the material M. When the applicator 50 takes the position and orientation to supply the material M, the program proceeds to Step ST2.

In Step ST2, the control unit 110 controls the material supply unit moving device 90 to move the material supply unit 80 to the supply position where it supplies the material M to the applicator 50. FIG. 1 shows a state where the position and orientation of the applicator 50 relative to the substrate 20 are those for the start of the application of the material M and the material supply unit 80 is in the supply position. When the material supply unit 80 is moved to the supply position, the control unit 110 controls the supply unit 80 to introduce the material M onto the surface 53 of the applicator 50.

Figure 5:
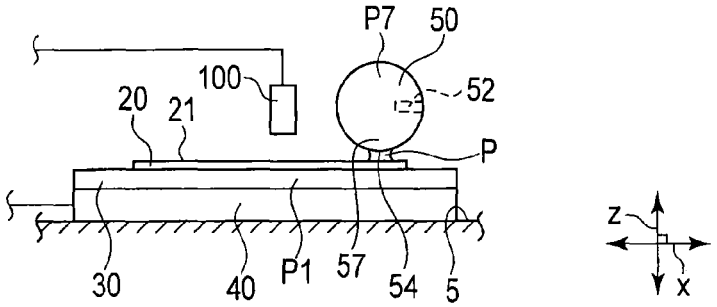
FIG. 5 is a front view showing how a meniscus Pillar of a material is formed between the applicator and a surface of a substrate shown in FIG. 1.

When the material is supplied to the applicator 50, the control unit 110 controls the material supply unit moving device 90 to move the material supply unit 80 to a position where it does not interfere with the movement of the substrate stage 30. When the movement of the material supply unit 80 is completed, the program proceeds to Step ST3. FIG. 5 shows how the meniscus pillar P of the material M is formed between the applicator 50 and the surface 21 of the substrate 20 by the introduction of the material M onto the surface 53 of the applicator 50.

In Step ST3, the control unit 110 controls the stage moving device 40 to move the substrate stage 30 from the application start position P1 to the application end position P2. When this is done, the movement speed of the substrate stage 30 is constant. When the movement of the substrate stage 30 is started, the program proceeds to Step ST4.

In Step ST4, the control unit 110 determines whether or not the distance of the gap S between the applicator 50 and the surface 21 of the substrate 20 along the z-axis is the first predetermined distance L1. The following is a specific description of this operation. When the substrate stage 30 moves from the application start position P1 to the application end position P2, as described above, the sensor 100 is located ahead of the applicator 50 in the direction of the advance of the applicator 50 relative to the substrate 20.

Thus, the sensor 100 faces the position of the surface 21 of the substrate 20 before the application of the material M. In other words, the sensor 100 detects the z-coordinate of that position of the surface 21 of the substrate 20 where the material M is to be applied. The result of this detection is stored in the storage unit 111.

Based on the z-coordinate on the surface 21 of the substrate 20 detected in this manner, the control unit 110 detects the distance of the z-direction gap S in the position where the surface 21 of the substrate 20 faces the lowermost end 54 of the applicator 50 in the direction where the meniscus pillar P extends. When the substrate stage 30 is in the application start position P1, as shown in FIG. 1, the sensor 100 is located inwardly relative to an end of a range of the surface 21 of the substrate 20 to be coated with the material M. The x-coordinate of that position of the surface 21 of the substrate 20 which faces the sensor 100 along the z-axis is assumed to an initial position P8.

In FIG. 1, a range from one x-direction end of the range of the surface 21 of the substrate 20 to be coated with the material M to the initial position P8 is illustrated as a range B. The z-coordinate of the range B may be determined in advance before the start of the operation in Step ST3. The range B can also be controlled to be a predetermined interval by previously scanning and detecting its z-coordinate.

If the z-direction distance of the gap S between the applicator 50 and the position on the surface 21 of the substrate 20 through which the meniscus pillar P passes is not the preset first predetermined distance L1, the control unit 110 proceeds to Step ST5. In Step ST5, the control unit 110 controls the z-axis applicator moving device 60 so that the z-direction distance of the gap S becomes the preset first predetermined distance L1. The distance of the preset gap S is fixed according to the thickness of the film to be obtained. When the z-direction distance of the gap S is adjusted to the first predetermined distance L1, the program proceeds to Step ST6. If the z-direction distance of the gap S is the first predetermined distance L1, in contrast, the program proceeds directly from Step ST4 to Step ST6.

Figure 6:
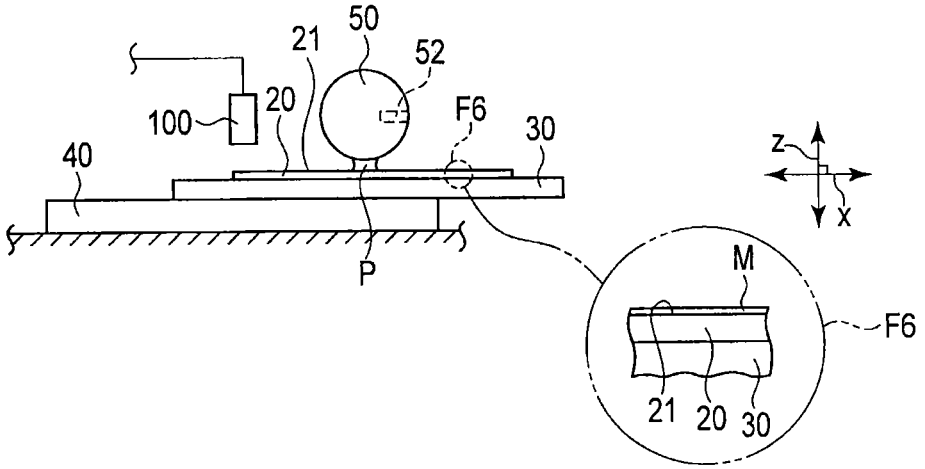
FIG. 6 is a front view of the coating apparatus showing a state where a substrate stage shown in FIG. 1 is moving from an application start position toward an application end position.

The operation of Step ST4 is continued until the substrate stage 30 reaches the application end position P2. FIG. 6 shows a state where the substrate stage 30 is moving from the application start position P1 toward the application end position P2. In FIG. 6, a range F6 surrounded by a two-dot chain line is shown in an enlarged scale. The enlarged range F6 indicates that part of the surface 21 of the substrate 20 which is passed by the meniscus pillar P. As indicated by the range F6, the surface 21 of the substrate 20 is coated with the material M after the passage of the meniscus pillar P.

Figure 7:
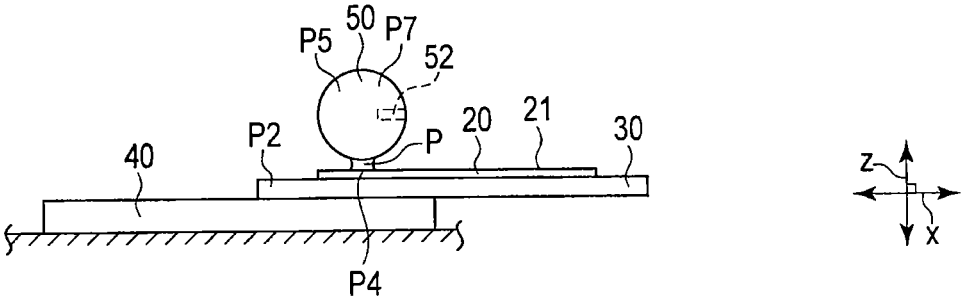
FIG. 7 is a front view of the coating apparatus showing the substrate stage of FIG. 6 having reached the application end position.

In Step ST6, the control unit 110 determines whether or not the substrate stage 30 has reached the application end position P2. FIG. 7 shows the substrate stage 30 having reached the application end position P2. When the substrate stage 30 reaches the application end position P2, as shown in FIG. 7, the program proceeds to Step ST7. In Step ST7, the control unit 110 controls the stage moving device 40 to terminate the movement of the substrate stage 30. Then, the program proceeds to Step ST8.

In Step ST8, the control unit 110 controls the applicator pivoting device 70 to pivot the applicator 50 from the application rotational position P5 to the material recovery rotational position P6. When the applicator 50 is pivoted to the material recovery rotational position P6, the control unit 110 terminates the pivoting of the applicator 50. The rotational position of the applicator is detected by a sensor 59 attached to, for example, the applicator pivoting device 70, and is transmitted to the control unit 110. In this way, the control unit 110 can ascertain the rotational position of the applicator 50. When the applicator 50 is in the material recovery rotational position P6, its holes 52 are located opposite the surface 21 of the substrate 20 along the z-axis.

While the applicator 50 is pivoting, surface tension acts between the applicator 50 and the surface 21 of the substrate 20, thereby continuing the formation of the meniscus pillar P of the material M. If the holes 52 are located opposite the surface 21 of the substrate 20 along the z-axis with the meniscus pillar P of the material M formed therebetween, the material M that forms the meniscus pillar P is introduced into the holes 52 by surface tension. The control unit 110 secures the applicator 50 to the material recovery rotational position P6 until a predetermined time has elapsed following the rotation of the applicator 50 to the material recovery rotational position P6. This predetermined time, which is a time required for the introduction of a surplus of the material M into the holes 52, can be obtained in advance by an experiment or the like. The surplus of the material M is a portion of the material unnecessary for the attainment of the x- and y-direction dimensions and z-direction thickness of the film to be obtained.

Figure 8:
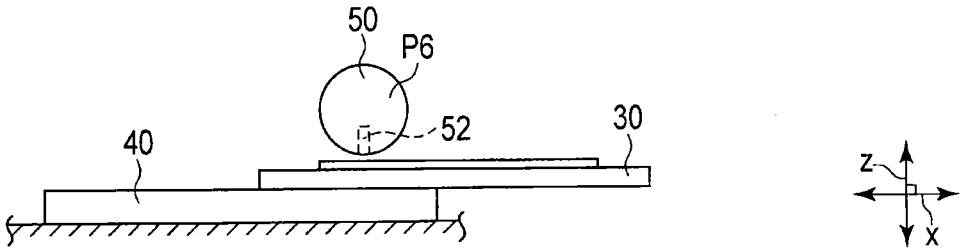
FIG. 8 is a front view of the coating apparatus showing a state after a predetermined time has elapsed following the rotation of the applicator of FIG. 7 to a material recovery rotational position.

FIG. 8 shows a state after the predetermined time has elapsed following the rotation of the applicator 50 to the material recovery rotational position P6. FIG. 8 shows a state that the surplus of the material M has entered in to the holes 52.

The surplus of the material M is recovered by being introduced into the holes 52, so that the thickness of the material being applied M, that is, the thickness of the film to be formed, can be prevented from becoming uneven even near the other x-direction end of the material being applied M. When the predetermined time has elapsed, the program proceeds to Step ST9.

Figure 9:
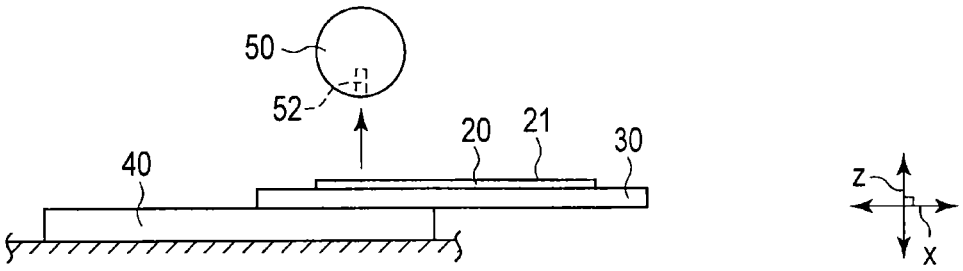
FIG. 9 is a front view of the coating apparatus showing the applicator of FIG. 8 separated from the surface of the substrate along a z-axis.

FIG. 9 shows the applicator 50 separated from the surface 21 of the substrate 20 along the z-axis. In Step ST9, as shown in FIG. 9, the control unit 110 controls the z-axis applicator moving device 60 to move the applicator 50 away from the surface 21 of the substrate 20 along the z-axis, whereupon the operation of the coating apparatus 10 ends.

In the coating apparatus 10 constructed in this manner, the applicator 50 is formed with the holes 52, and the surplus of the material M is recovered by locating the holes 52 opposite the surface 21 of the substrate 20 in the application end position P2. In this way, the thickness of the film to be formed can be prevented from becoming uneven even near the second position P4 of the surface 21 of the substrate 20, that is, the one x-direction end of the film.

A coating apparatus according to a second embodiment will now be described with reference to FIG. 10. Same reference numbers are used to designate constituent elements of the first and second embodiments having the same functions, and a repeated description of those elements is omitted. The second embodiment differs from the first embodiment in the operation of a control unit 110. The configuration of the coating apparatus 10 according to the present embodiment is the same as that in the first embodiment. The following is a description of the different point.

Figure 10:
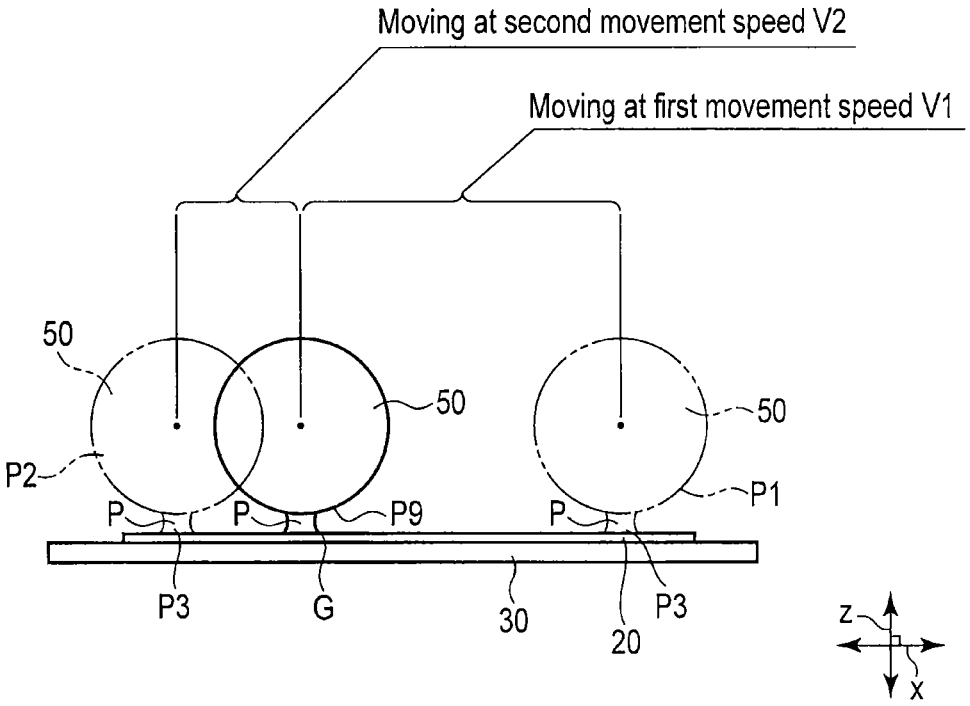
FIG. 10 is a front view showing a principal part of a coating apparatus according to a second embodiment.

FIG. 10 is a schematic view showing how the speed of movement of a substrate stage 30 from an application start position P1 to an application end position P2 changes. In the present embodiment, as shown in FIG. 10, the movement speed of the substrate stage 30 changes at a position halfway between the application start and end positions P1 and P2. Other behaviors of the control unit 110 are the same as those in the first embodiment.

In FIG. 10, the substrate stage 30 is fixed, and an applicator 50 is configured to move relative to the substrate stage 30, in order to illustrate the movement of the substrate stage 30 relative to the applicator 50. Specifically, two-dot chain lines indicate the applicator 50 located relative to the substrate stage 30 in such states that the stage 30 is in the application start and end positions P1 and P2. On the other hand, a full line indicates the applicator 50 located relative to the substrate stage 30 in such a state that the stage 30 is in a speed-reduction position P9.

The speed of movement of the substrate stage 30 from the application start position P1 to the speed-reduction position P9 is assumed to be a first movement speed v1. The movement speed after the passage of the speed-reduction position P9 is assumed to be a second movement speed v2.

The thickness of a material M applied to a surface 21 of a substrate 20 varies depending on the speed of movement of a meniscus pillar P relative to the surface 21. More specifically, the thickness of the material being applied M along the z-axis increases as the speed of movement of the meniscus pillar P relative to the surface 21 of the substrate 20 increases.

When the substrate stage 30 reaches the application end position P2, on the other hand, the movement of the meniscus pillar P relative to the surface 21 of the substrate 20 stops. Since the material M continues to be introduced to the position of the surface 21 of the substrate 20 that faces the meniscus pillar P, however, the thickness of the material being applied M is liable to increase.

The speed-reduction position P9 is a position where one end of the meniscus pillar P and one end G of a range where the z-direction thickness of the material M that is superfluously applied near a second position P4 of the surface 21 of the substrate 20, as the movement of the substrate stage 30 stops at the application end position P2, spreads so that the z-direction thickness becomes slightly greater than a desired thickness face each other along the z-axis.

The second movement speed v2 is lower than the first movement speed v1. Therefore, the thickness of the material M applied to the surface 21 of the substrate 20 as the substrate stage 30 moves from the speed-reduction position P9 to the application end position P2 is smaller than the z-direction thickness of the material M applied to the substrate surface 21 as the substrate stage 30 moves from the application start position P1 to the speed-reduction position P9.

The first movement speed v1 is set so that the thickness of the material being applied M is equal to a preset thickness. The second movement speed v2 is set in consideration of an increase in the z-direction thickness of the material M due to the above-described superfluous application near the second position P4 of the surface 21 of the substrate 20. More specifically, the second movement speed v2 is determined so that the sum of the thickness of the material being applied M determined by the second movement speed v2 and the increase in the thickness due to the superfluous application to the second position P4 of the surface 21 of the substrate 20 is equal to the z-direction thickness of the material being applied M determined by the first movement speed v1. Accordingly, the second movement speed is lower than the first movement speed. The second movement speed v2 is set also in consideration of the amount of the material M recovered by the holes 52.

Figure 11:
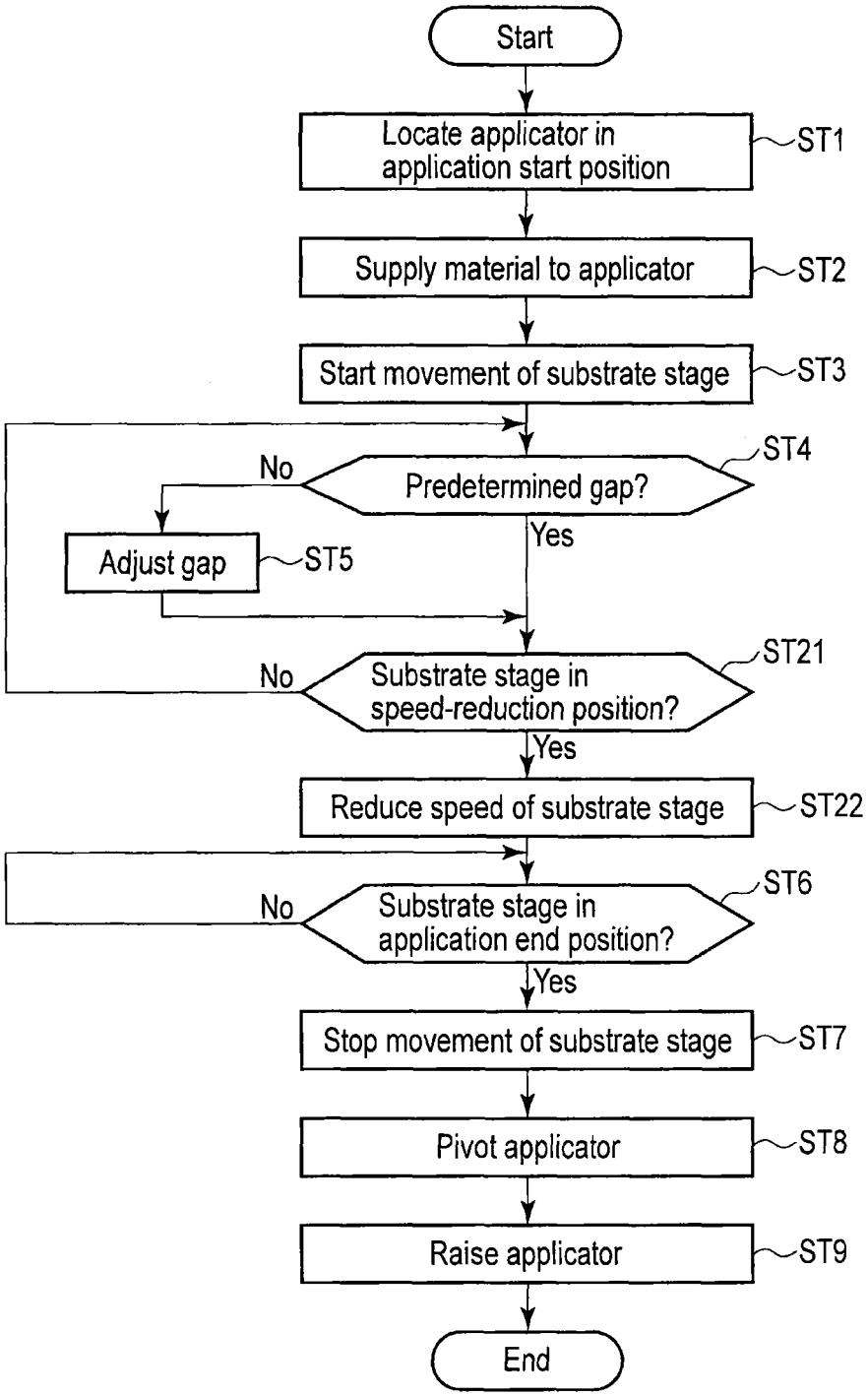
FIG. 11 is a flowchart illustrating the operation of a control unit of the coating apparatus of the second embodiment.

FIG. 11 is a flowchart illustrating the operation of the control unit 110. In the present embodiment, as described above, the movement speed of the substrate stage 30 is changed to the second movement speed v2 when the speed-reduction position P9 is passed by the substrate stage 30.

To this end, the present embodiment further comprises processes of Steps ST21 and ST22. Steps ST21 and ST22 are performed between Step ST4 or ST5 and Step ST6. When the process of Step ST4 or ST5 ends, the program proceeds to Step ST21.

In Step ST21, the control unit 110 determines whether or not the substrate stage 30 has reached the speed-reduction position P9. If the substrate stage 30 is not determined to have reached the speed-reduction position P9, the program returns from Step ST21 to Step ST4. If the substrate stage 30 is determined to have reached the speed-reduction position. P9, the program proceeds to Step ST22.

In Step ST22, the control unit 110 controls a stage moving device 40 to reduce the movement speed of the substrate stage 30 from the first movement speed v1 to the second movement speed v2. Thereupon, the program proceeds to Step ST7.

In the present embodiment, the material M is recovered by means of the holes 52, and the amount of the material M applied near the second position of the surface 21 of the substrate 20, the z-direction thickness of which is liable to increase on the surface 21, can be reduced. Therefore, the possibility of the thickness of the material being applied M becoming uneven can be further reduced.

A coating apparatus according to a third embodiment will now be described with reference to FIGS. 12 and 13. Same reference numbers are used to designate constituent elements of the first and third embodiments having the same functions, and a repeated description of those elements is omitted. According to the present embodiment, the coating apparatus 10 comprises a suction device 120 and tank 130, which stores a drawn material M, in addition to the structure of the first embodiment. Further, the third embodiment differs from the first embodiment in the structure of an applicator 50 and the operation of a control unit 110. The third embodiment is not different in other points from the first embodiment. The following is a description of the different points.

Figure 12:
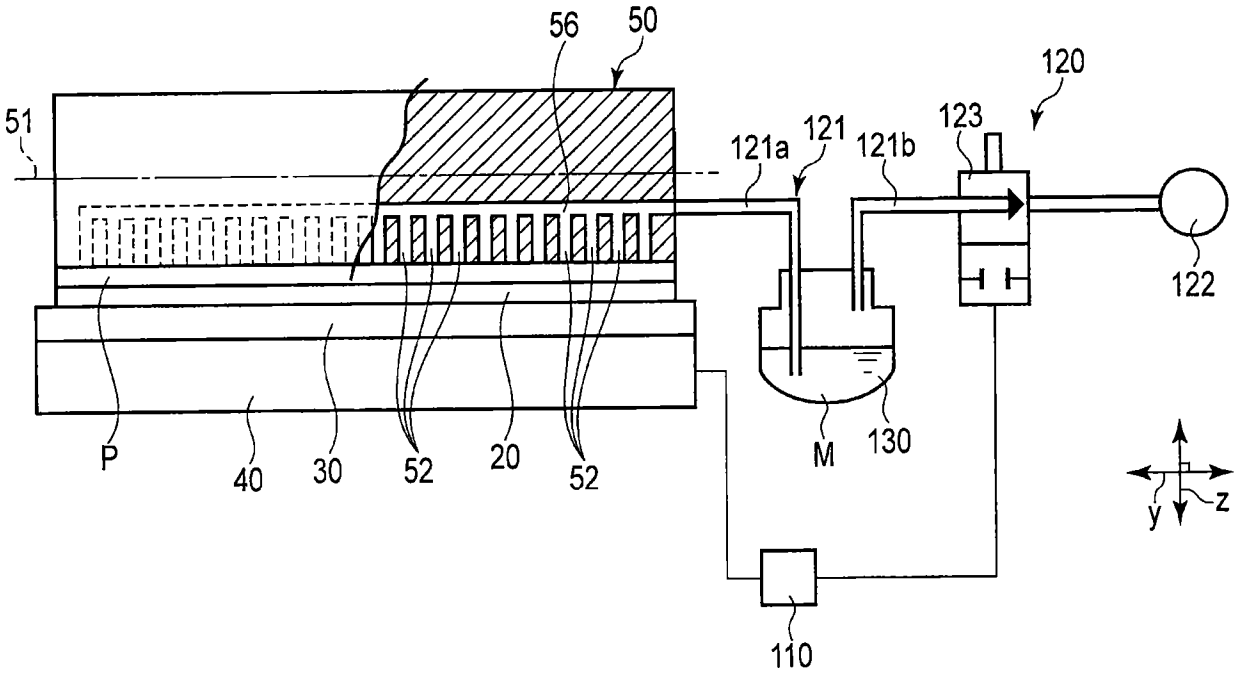
FIG. 12 is a front view showing a coating apparatus according to a third embodiment.
Figure 13:
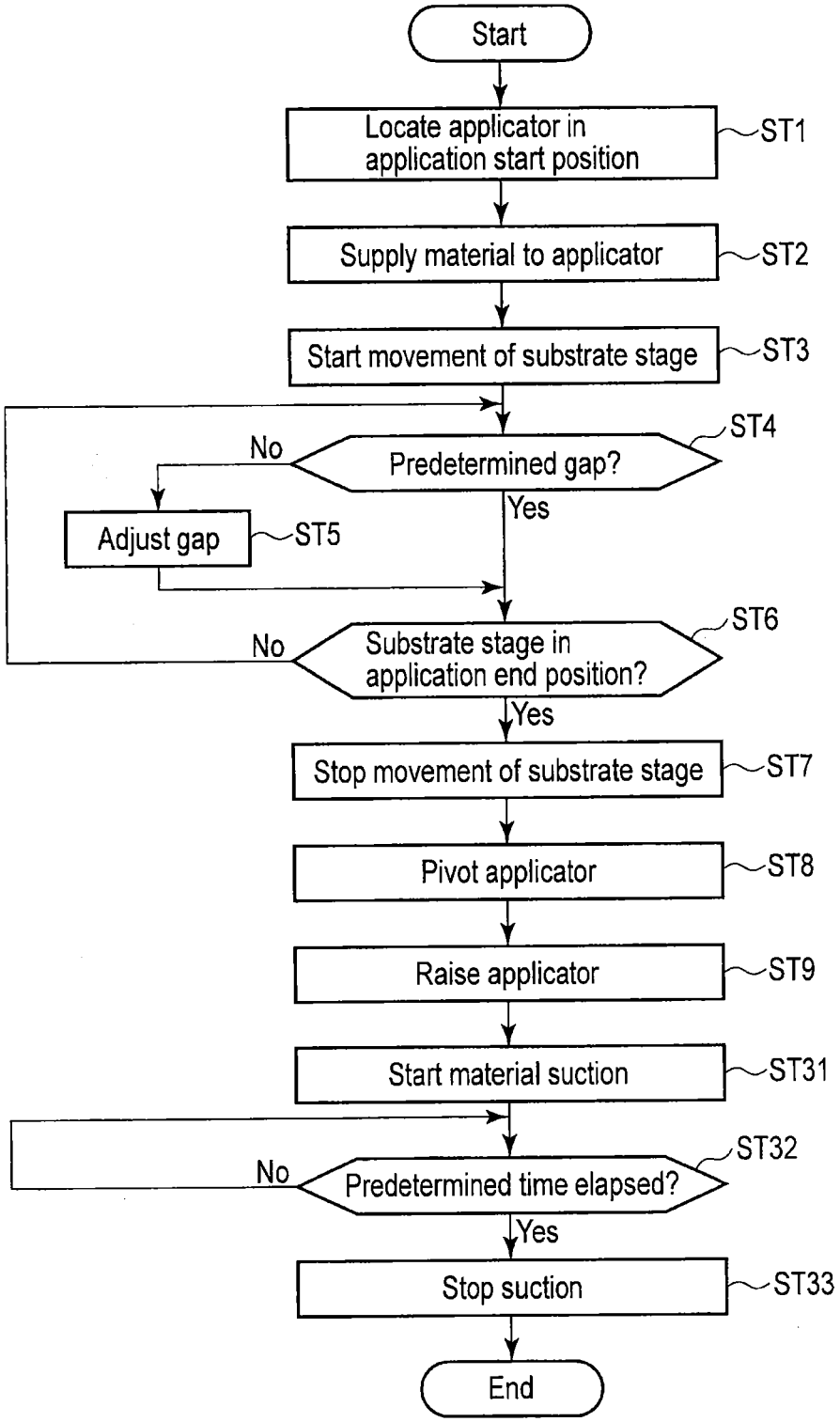
FIG. 13 is a flowchart illustrating the operation of a control unit shown in FIG. 12.

FIG. 12 is a front view schematically showing a part of the coating apparatus 10 of the present embodiment. Actually, the coating apparatus 10 also comprises a z-axis applicator moving device 60, applicator pivoting device 70 for pivoting the applicator 50, material supply unit 80 that supplies the material M to the applicator 50, and material supply unit moving device 90. For ease of illustration, however, these elements are not shown in FIG. 12. As shown in FIG. 12, the coating apparatus 10 further comprises the suction device 120 and tank 130. A communicating passage section 56 is formed within the applicator 50. The passage section 56 communicates with holes 52 and opens in one end of the applicator 50.

The suction device 120 comprises a suction passage section 121, negative pressure generator 122, and valve 123. The suction passage section 121 is formed of, for example, a pipe member. The passage section 121 connects the negative pressure generator 122 and communicating passage section 56.

The valve 123 is formed in a part of the suction passage section 121. The valve 123 is configured to be opened and closed so that the state of internal communication of the suction passage section 121 is changed. If the valve 123 is opened, negative pressure produced by the negative pressure generator 122 acts on the communicating passage section 56. The "negative pressure", as stated herein, is a sufficient negative pressure to draw in the material M in the holes 52. The operation of the valve 123 is controlled by the control unit 110.

The tank 130 is incorporated in the suction passage section 121. Specifically, the suction passage section 121 comprises a first portion 121*a* extending from the communicating passage section 56 to the tank 130 and a second portion 121*b* extending from the tank 130 to the negative pressure generator 122.

The first portion 121*a* extends up to the bottom part of the tank 130 and opens into the tank. The second portion 121*b* extends up to the top part of the tank 130 and opens into the tank. In this structure, the drawn material M is discharged into the tank 130 through the first portion 121*a*.

The following is a description of the operation of the coating apparatus 10 according to the present embodiment. FIG. 13 is a flowchart illustrating the operation of the coating apparatus 10 of the present embodiment. In the present embodiment, as shown in FIG. 13, processes of the control unit 110 further comprises processes of Steps ST31, ST32 and ST33.

When the process of Step ST9 ends, the program proceeds to Step ST31. In Step ST31, the control unit 110 opens the valve 123. Thereupon, the negative pressure produced by the negative pressure generator 122 acts on the communicating passage section 56. Accordingly, the material M drawn into the holes 52 is moved and stored into the tank 130. When the valve 123 is opened, the program proceeds to Step ST32.

In Step ST32, the control unit 110 determines whether or not a predetermined time has elapsed following the opening of the valve 123. This predetermined time, which is a time for all the material M in the holes 52 to be moved into tank 130, can be obtained in advance by an experiment or the like. The valve 123 is kept open until the predetermined time has elapsed. If it is determined that the predetermined time has elapsed, the program proceeds to Step ST33.

In Step ST33, the control unit 110 closes the valve 123. Thereupon, the negative pressure ceases to act on the communicating passage section 56, so that the drawing operation is stopped.

According to the present embodiment, such an effect can be obtained that the material M introduced into the holes 52 can be stored in the tank 130, in addition to the effects of the first embodiment. The recovered material M can be reused.

A coating apparatus according to a fourth embodiment will now be described with reference to FIGS. 14 and 15. Same reference numbers are used to designate constituent elements of the third and fourth embodiments having the same functions, and a repeated description of those elements is omitted.

According to the present embodiment, the coating apparatus 10 further comprises a suction check sensor 140. Moreover, the present embodiment differs from the third embodiment in the operation of a control unit 110. The fourth embodiment is not different in other points from the third embodiment. The following is a description of the different points.

Figure 14:
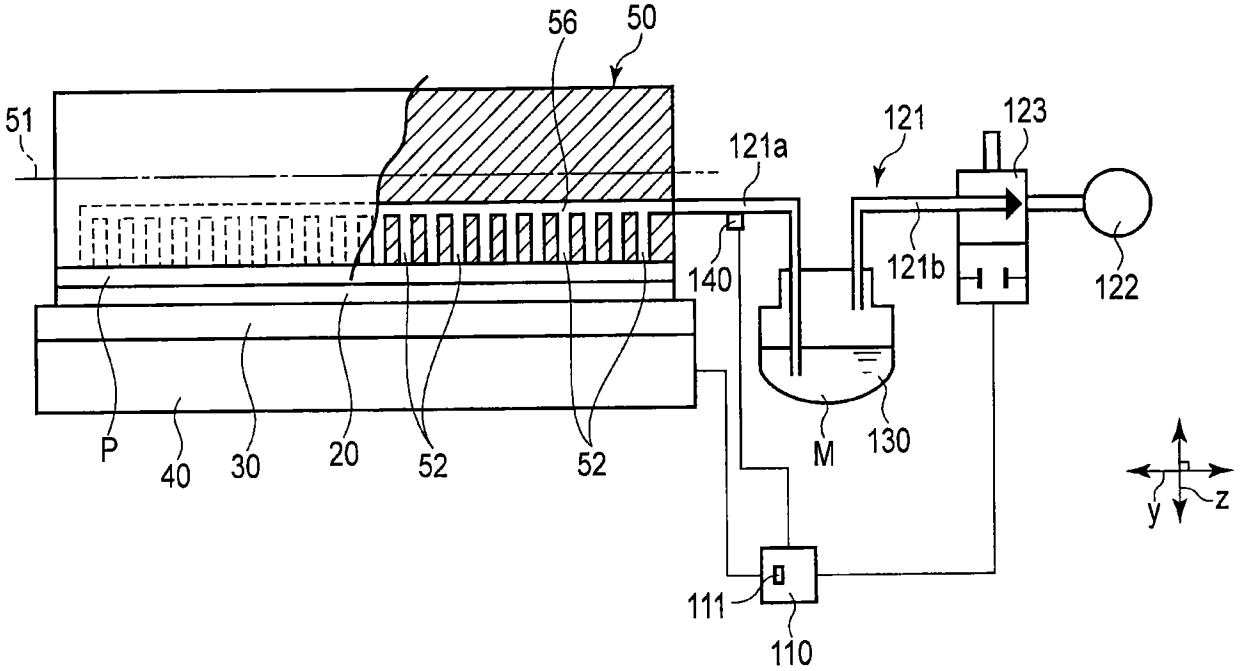
FIG. 14 is a front view showing a coating apparatus according to a fourth embodiment.

FIG. 14 is a front view schematically showing a part of the coating apparatus 10 of the present embodiment. Actually, the coating apparatus 10 also comprises a z-axis applicator moving device 60, applicator pivoting device 70 for pivoting an applicator 50, material supply unit 80 that supplies a material M to the applicator 50, and material supply unit moving device 90. For ease of illustration, however, these elements are not shown in FIG. 14. As shown in FIG. 14, the coating apparatus 10 of the present embodiment comprises the suction check sensor 140. The suction check sensor 140 is located upstream relative to a tank 130 in a suction passage section 121. The suction check sensor 140 detects whether or not the material M is flowing through the suction passage section 121. The result of the detection is transmitted to the control unit 110.

Figure 15:
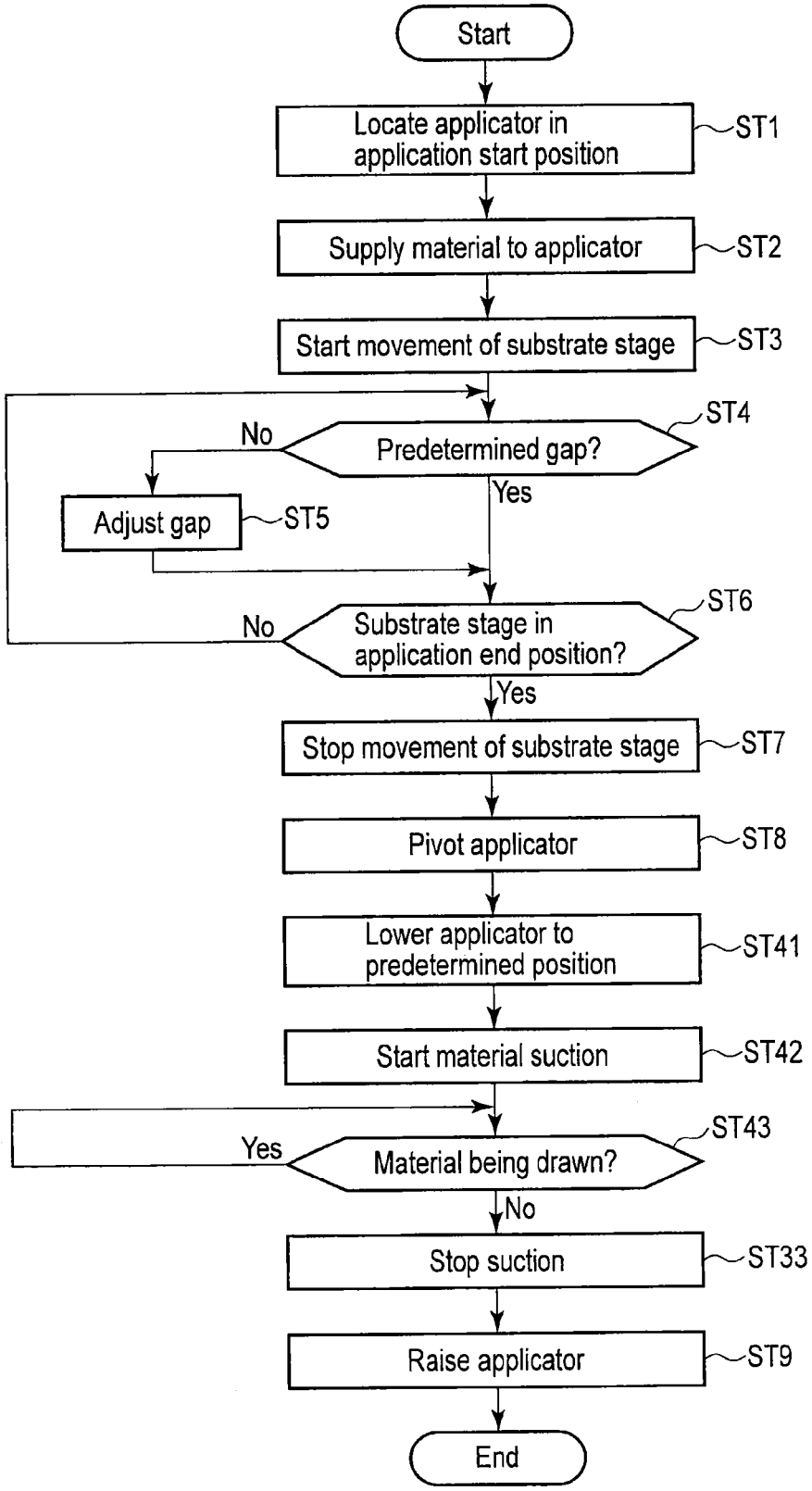
FIG. 15 is a flowchart illustrating the operation of a control unit shown in FIG. 14.

FIG. 15 is a flowchart illustrating the operation of the control unit 110 of the present embodiment. In the present embodiment, as shown in FIG. 15, processes of the control unit 110 do not comprise the processes of Steps ST31 and ST32 described in connection with the third embodiment. Instead, processes of Steps ST41, ST42 and ST43 are added.

When the process of ST8 ends, the program proceeds to Step ST41. In ST41, the control unit 110 lowers the applicator 50 to a predetermined position. The "predetermined position", as stated herein, is such a position that a completed film has a desired thickness and that the z-direction distance of a gap S between the holes 52 and the top surface of the material being applied M is a second predetermined distance L2 corresponding to the film thickness.

The "second predetermined distance L2 corresponding to the film thickness", as stated herein, is such a distance that a gap is formed between the holes 52 and the top surface of the material being applied M as the top surface of the material being applied is lowered by suction, so that the material obtains the desired thickness when it ceases to be drawn. Thereupon, the program proceeds to Step ST42.

In the present embodiment, a reference position of the holes 52 used in determining the distance between the holes 52 and a surface 21 is, for example, the lowermost end position of the edges of the holes 52. The applicator 50 is lowered to such a position that the distance between the reference position and surface 21 is the second predetermined distance. The z-coordinate of the reference position, that is, the lowermost end position of the edges of the holes 52, is stored in advance in a storage unit 111 of the control unit 110.

The reference position of the holes 52 may be other than the lowermost end position. An alternative example of the reference position of the holes 52 may be the position of a flat surface that is formed by chamfering that part of the applicator 50 where the holes 52 are formed. In this case, the flat surface is designed to extend perpendicular to the z-axis when the applicator 50 is in a material recovery rotational position P6.

The second predetermined distance L2 is suitably determined according to various conditions, such as suction pressure for the material M, size of the holes 52, etc. The second predetermined distance L2 can be obtained in advance by an experiment or the like. Further, the second predetermined distance L2 also varies depending on the reference position of the holes 52. Even if the second predetermined distance changes according to the reference position of the holes 52, however, the z-direction position of the applicator 50 relative to the surface 21 does not.

In Step ST42, the control unit 110 opens a valve 123. If the valve 123 is opened, negative pressure acts on a communicating passage section 56, so that the material M is drawn in through the holes 52 and communicating passage section 56. When the valve 123 is opened, the program proceeds to Step ST43.

In Step ST43, the control unit 110 determines whether or not the material M is being drawn in, based on the result of the detection by the suction check sensor 140. If it is determined that the material M is being drawn in, the valve 123 is kept open. If it is determined that the material is not being drawn in, the program proceeds to Step ST33.

In the present embodiment, the negative pressure generator 122 is capable of producing a sufficient negative pressure to draw in the material M through the holes 52.

In the present embodiment, if the thickness of the material being applied M becomes the desired thickness as the applicator 50 is lowered to a position corresponding to the desired film thickness, the material ceases to be drawn in. Thus, the thickness of the material M can be prevented from becoming uneven.

In the present embodiment, suction of the material M is stopped based on the result of the detection by the suction check sensor 140. Alternatively, it may be stopped based on the time elapsed following its start, for example. Specifically, the time elapsed between the start and end of the suction of the material M is obtained in advance by an experiment or the like so that the suction can be stopped based on the obtained time. The same effects as those of each embodiment can be obtained also in this case. Since the suction check sensor 140 is unnecessary, moreover, the coating apparatus 10 can be simplified.

A coating apparatus according to a fifth embodiment will now be described with reference to FIG. 16. Same reference numbers are used to designate constituent elements of the fourth and fifth embodiments having the same functions, and a repeated description of those elements is omitted. The present embodiment differs from the fourth embodiment in that a communicating passage section 56 opens at both ends of an applicator 50 and a suction passage section 121 comprises a pair of first portions 121*a*. The fifth embodiment is not different in other points from the fourth embodiment. The following is a description of the different points.

Figure 16:
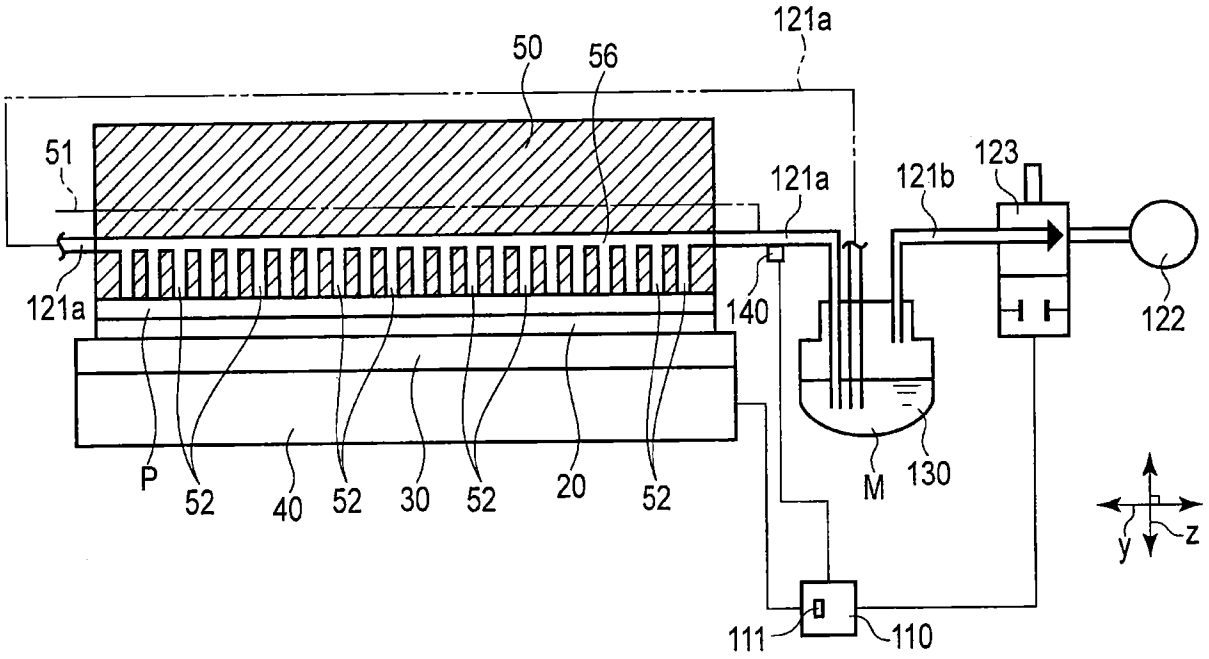
FIG. 16 is a front view showing a coating apparatus according to a fifth embodiment.

FIG. 16, like FIG. 14, is a front view schematically showing the applicator 50 of the coating apparatus 10 of the present embodiment. In FIG. 16, the applicator 50 is cut along an axis 51. In the present embodiment, as shown in FIG. 16, the communicating passage section 56 opens at both ends of the applicator 50. The opposite openings of the passage section 56 communicate with a tank 130 through the first portions 121*a*. The first portion 121*a* that connects the interior of the tank 130 and the opening of the communicating passage section 56 at the other end of the applicator 50 is indicated by a two-dot chain line and shown as extending above the applicator 50. However, this first portion 121*a* is shown as extending above the applicator 50 for better visual presence. Actually, the first portion 121*a* is not limited to the location above the applicator 50. It is located in consideration of the ease of suction of a material M.

According to the present embodiment, negative pressure acts from both sides of the communicating passage section 56, so that negative pressure that acts on holes 52 can be prevented from becoming uneven, so that the thickness of the material being applied M can also be prevented from becoming uneven.

The coating apparatus 10 of the third embodiment, like that of the present embodiment, may also be configured so that the communicating passage section 56 opens at both ends of the applicator 50 and the suction passage section 121 comprises a pair of first portions 121*a*.

A coating apparatus according to a sixth embodiment will now be described with reference to FIG. 17. Same reference numbers are used to designate constituent elements of the first and sixth embodiments having the same functions, and a repeated description of those elements is omitted. The present embodiment differs from the first embodiment in the arrangement of the holes 52. The sixth embodiment is not different in other points from the first embodiment. The following is a description of the different point.

Figure 17:
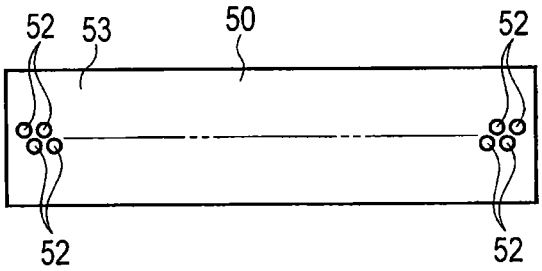
FIG. 17 is a side view showing a surface of an applicator of a coating apparatus according to a sixth embodiment in a direction where holes can be viewed.

FIG. 17 is a side view showing a surface 53 of an applicator 50 in a direction where holes 52 can be viewed. In the present embodiment, as shown in FIG. 17, the holes 52 are arranged in two rows. Some of the holes 52 are not actually shown but indicated by a two-dot chain line.

In the present embodiment, the openings of the holes 52 cover so wide a range that the film thickness can be further prevented from becoming uneven as a meniscus pillar P is separated from a surface 21 of a substrate 20.

Also in the second to fifth embodiments, the holes 52 may be arranged in two rows as in the present embodiment. In this case, such an effect can be obtained that the film thickness can be further prevented from becoming uneven as the meniscus pillar P is separated, in addition to the effects of the foregoing embodiments.

A coating apparatus according to a seventh embodiment will now be described with reference to FIG. 18. Same reference numbers are used to designate constituent elements of the first and seventh embodiments having the same functions, and a repeated description of those elements is omitted.

Figure 18:
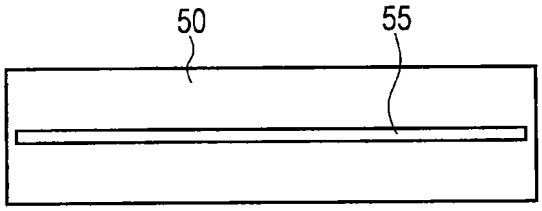
FIG. 18 is a side view showing a surface of an applicator of a coating apparatus according to a seventh embodiment in a direction where a slit can be viewed.

FIG. 18 is a side view showing a surface 53 of an applicator 50 according to the present embodiment. In the present embodiment, as shown in FIG. 18, a single slit 55 is formed in place of a plurality of holes 52. The slit 55 is formed in the position where the holes 52 are formed. When the applicator 50 pivots to a material recovery rotational position P6, the slit 55 is located opposite a surface 21 of a substrate 20. The slit 55 extends into the applicator 50. A material M is introduced into the slit 55.

As in the sixth embodiment, slits 55 may be arranged in two rows. The present embodiment can also provide the same effects as those of the first embodiment. Also in the second to fifth embodiments, the slit 55 described in connection with the present embodiment may be used in place of the holes 52. The same effects as those of each embodiment can be obtained also in this case. If the applicator 50 is formed with the slit 55 in the fourth embodiment, it is lowered to such a position that the distance between a reference position of the slit 55 and the surface 21 of the substrate 20 is a second distance corresponding to a desired film thickness.

A coating apparatus according to an eighth embodiment will now be described with reference to FIGS. 19 to 22. Same reference numbers are used to designate constituent elements of the first and eighth embodiments having the same functions, and a repeated description of those elements is omitted.

In the present embodiment, a y-axis applicator moving device 150 that moves an applicator 50 along the y-axis is provided in place of the applicator pivoting device 70. Further, the present embodiment differs from the first embodiment in the structure of the applicator 50 and the operation of a control unit 110. The eighth embodiment is not different in other points from the first embodiment. The following is a description of the different points.

Figure 19:
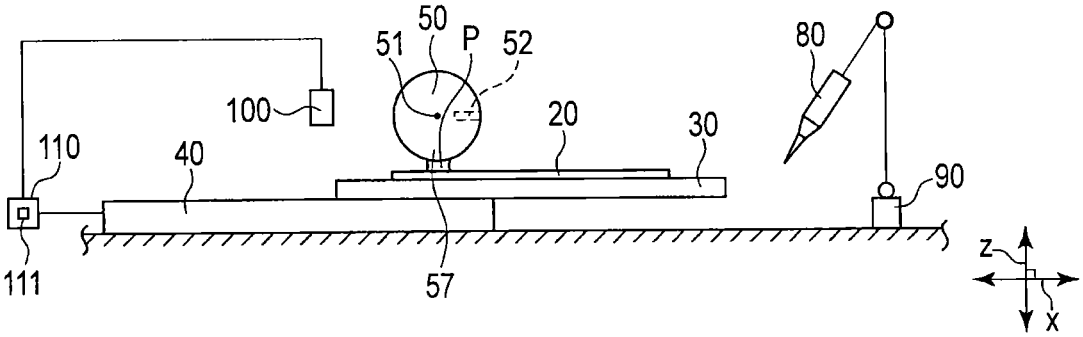
FIG. 19 is a front view showing a coating apparatus according to an eighth embodiment.
Figure 20:
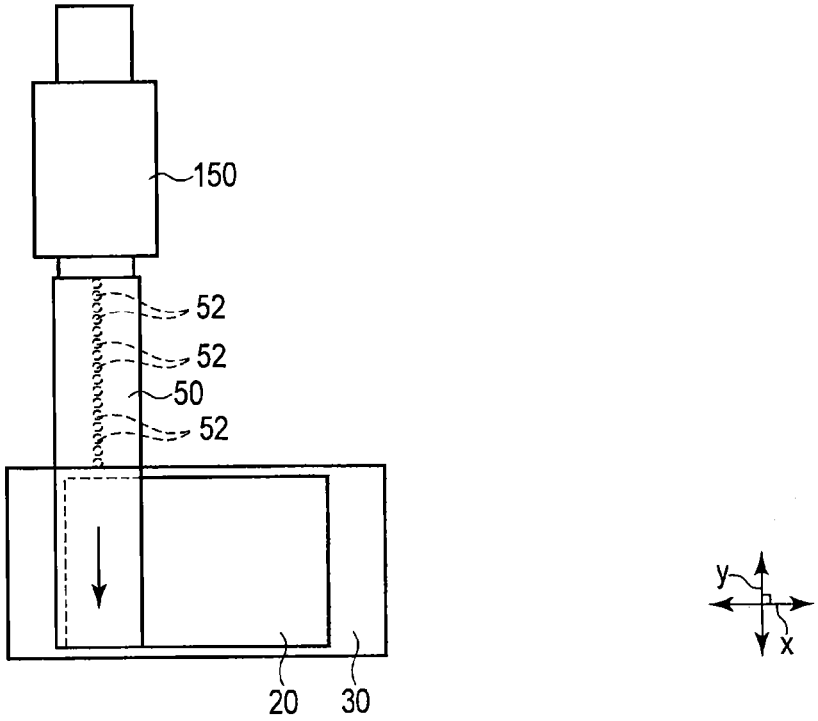
FIG. 20 is a top view an applicator, substrate stage, and y-axis applicator moving device of the coating apparatus shown in FIG. 19.

FIG. 19 is a front view schematically showing the coating apparatus 10 of the present embodiment. FIG. 20 is a top view showing the applicator 50, a substrate stage 30, and the y-axis applicator moving device 150 of the coating apparatus 10. The applicator 50 is a circular column having a circular cross-section perpendicular to an axis 51. The axis 51 extends parallel to the y-axis.

In the present embodiment, as shown in FIG. 20, the y-axis applicator moving device 150 is provided in place of the applicator pivoting device 70. The y-axis applicator moving device 150 has the function of moving the applicator 50 along the y-axis while keeping the axis of the applicator 50 parallel to the y-axis. The moving device 150 is secured to the top part of a z-axis applicator moving device 60. The z-axis applicator moving device 60 moves the y-axis applicator moving device 150 along the z-axis while keeping the axis of the applicator 50 parallel to the y-axis. In the applicator 50 of the present embodiment, a meniscus pillar forming portion 57 and holes 52 are not located in different positions around the axis of the applicator 50 but arranged parallel to the axis 51.

Figure 21:
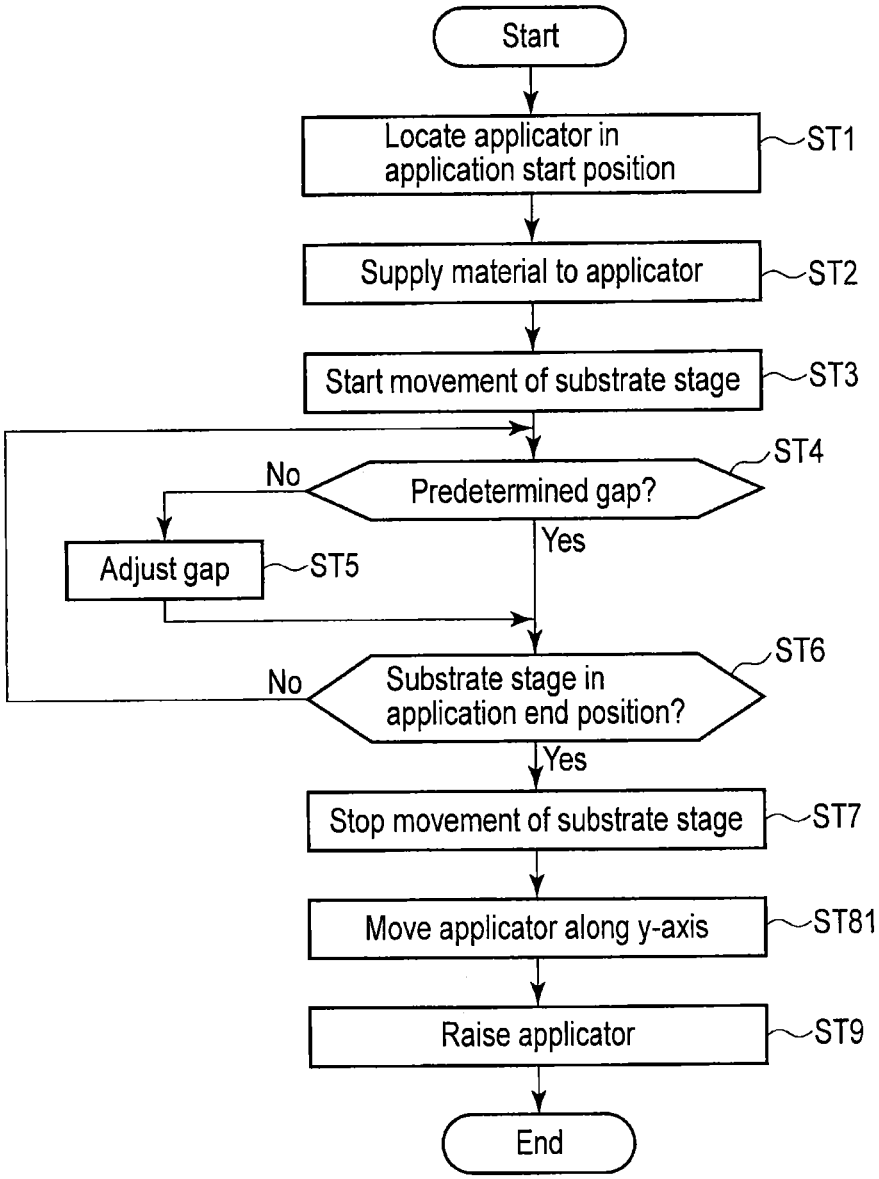
FIG. 21 is a flowchart illustrating the operation of a control unit shown in FIG. 19.

FIGS. 19 and 20 show the substrate stage 30 in an application end position P2. FIG. 21 is a flowchart illustrating the operation of the present embodiment. In the present embodiment, a process of Step ST81 is performed in place of Step ST8.

Figure 22:
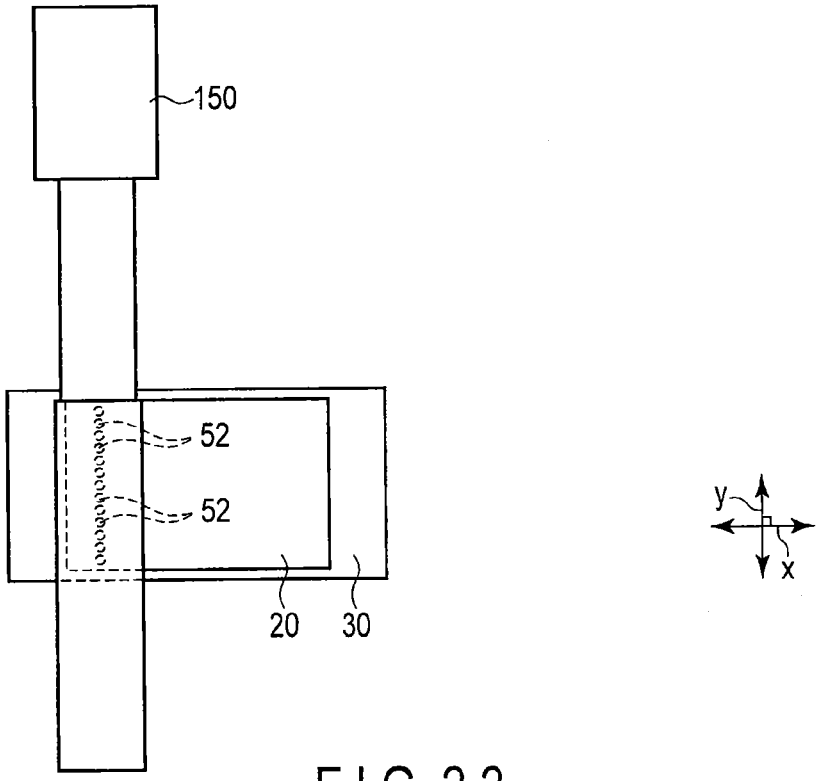
FIG. 22 is a top view showing how the applicator of FIG. 20 is moved along a y-axis to a position where recesses face a surface of a substrate along the z-axis.

The program proceeds from Step ST7 to Step ST81. In Step ST81, the control unit 110 controls the y-axis applicator moving device 150 to move the applicator 50 along the y-axis so that the holes 52 face a surface 21 of a substrate 20. FIG. 22 is a top view showing how the applicator 50 is moved along the y-axis to a position where the holes 52 face the surface 21 of the substrate 20 along the z-axis. This position is stored in advance in a storage unit 111.

When the applicator 50 is moved to the position where the holes 52 face the surface 21 of the substrate 20, the control unit 110 maintains this state for a predetermined time. This predetermined time, which is a time required for the introduction of a surplus of the material M into the holes 52, can be obtained in advance by an experiment or the like. This predetermined time is stored in advance in the storage unit 111. When the predetermined time has elapsed, the program proceeds to Step ST9.

The present embodiment can provide the same effects as those of the first embodiment.

While the applicator 50 comprises the holes 52 according to the present embodiment, the holes 52 may be arranged in two rows, as described in connection with the sixth embodiment. Further, the holes 52 may be replaced with the slit 55 described in connection with the seventh embodiment. Despite the use of the holes 52 or slit 55, moreover, the apparatus of the present embodiment may comprise the suction device 120, tank 130, and control unit 110 described in connection with the third to fifth embodiments. Also in the present embodiment, the movement speed of the applicator 50 may be controlled in the same manner as in the second embodiment.

Although the substrate 20 is used as an example of an object to be coated according to the first to eighth embodiments, it may be replaced with some other member.

The holes 52 described in connection with the first to sixth embodiments and the eighth embodiment are an example of recesses that are formed in a position different from that of the meniscus pillar forming portion of the applicator and are recessed relative to their surroundings. The slit 55 described in connection with the seventh embodiment is an example of a recess that is formed in a position different from that of the meniscus pillar forming portion of the applicator and is recessed relative to its surroundings.

The stage moving device 40 described in connection with the first to eighth embodiments comprises a mechanism that moves the substrate stage 30 along the x-axis. In other words, the stage moving device 40 comprises a mechanism that moves the position of the applicator 50 relative to the surface 21 of the substrate 20 along the surface 21. The stage moving device 40 is an example of a first moving mechanism that moves the position of the applicator relative to the surface to be coated of the object to be coated along the surface to be coated.

In the first to eighth embodiments, the position of the applicator is moved relative to the surface to be coated along the surface to be coated in such a manner that the first moving mechanism moves the object to be coated with the applicator fixed in place. As another example, the first moving mechanism may be configured to move the position of the applicator relative to the surface to be coated along the surface to be coated by moving the applicator. Alternatively, the first moving mechanism may be configured to move the position of the applicator relative to the surface to be coated along the surface to be coated by moving the applicator and the object to be coated.

In the first to seventh embodiments, the applicator pivoting device 70 comprises a mechanism that pivots the applicator 50 about the axis 51, thereby moving the meniscus pillar P, which is formed between the meniscus pillar forming portion 57 and the surface 21 of the substrate 20, between the surface 21 and holes 52 or slit 55. In other words, the applicator pivoting device 70 comprises a mechanism that moves the position of the applicator relative to the surface 21 of the substrate 20 so that the meniscus pillar P, which is formed between the meniscus pillar forming portion 57 and surface 21, between the surface 21 and holes 52 or slit 55. The applicator pivoting device 70 is an example of a second moving mechanism that moves the position of the applicator relative to the surface to be coated so that the meniscus pillar, which is formed between the meniscus pillar forming portion and surface to be coated, between the surface to be coated and recess(es).

In the first to seventh embodiments, moreover, the second moving mechanism moves the object to be coated with the applicator fixed in place. As another example, the second moving mechanism may be configured to move the applicator. Alternatively, the second moving mechanism may be configured to move both the applicator and the object to be coated.

In the eighth embodiment, the y-axis applicator moving device 150 comprises a mechanism that moves the applicator 50 along the y-axis, thereby moving the meniscus pillar P, which is formed between the meniscus pillar forming portion 57 and the surface 21 of the substrate 20, between the surface 21 and holes 52 or slit 55. In other words, the y-axis applicator moving device 150 comprises a mechanism that moves the position of the applicator relative to the surface 21 of the substrate 20 so that the meniscus pillar P, which is formed between the meniscus pillar forming portion 57 and surface 21, between the surface 21 and holes 52 or slit 55. The y-axis applicator moving device 150 is an example of the second moving mechanism that moves the position of the applicator relative to the surface to be coated so that the meniscus pillar, which is formed between the meniscus pillar forming portion and surface to be coated, between the surface to be coated and recess(es).

In the eighth embodiment, moreover, the applicator is moved with the object to be coated fixed in place. As another example, the object to be coated may be moved with the applicator fixed in place. Alternatively, both the applicator and the object to be coated may be moved.

In the first to eighth embodiments, the z-axis applicator moving device 60 comprises a mechanism that moves the applicator pivoting device 70 or y-axis applicator moving device 150 along the z-axis, thereby moving the applicator 50 toward and away from the surface 21 of the substrate 20. In other words, the z-axis applicator moving device 60 comprises a mechanism that moves the position of the applicator relatively toward and away from the surface to be coated. The z-axis applicator moving device 60 is an example of a third moving mechanism that moves the position of the applicator relatively toward and away from the surface to be coated.

In the first to eighth embodiments, moreover, the third moving mechanism moves the applicator with the object to be coated fixed in place. As another example, the third moving mechanism may be configured to move the object to be coated with the applicator fixed in place. Alternatively, the third moving mechanism may be configured to move both the applicator and the object to be coated.

The suction device 120 described in connection with the third to eighth embodiments comprises a suction mechanism that applies negative pressure to the holes 52 or slit 55. In other words, the suction device 120 is an example of a suction mechanism that applies negative pressure to the recess(es).

The tank 130 described in connection with the third to eighth embodiments has the function of storing the material M drawn by the suction device 120. In other words, the tank 130 is an example of a containing section that contains the material drawn by the suction device.

The present invention is not limited directly to the embodiments described herein, and in carrying out the invention, its constituent elements may be embodied in modified forms without departing from the spirit of the invention. Further, various inventions may be made by suitably combining a plurality of constituent elements described in connection with the foregoing embodiments. For example, some of the constituent elements according to the foregoing embodiments may be omitted. Furthermore, constituent elements according to different embodiments may be combined as required.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A coating apparatus which applies a material to an object to be coated, comprising:

an applicator comprising a meniscus pillar forming portion configured to form a meniscus pillar of the material in conjunction with a surface to be coated of the object to be coated and a recess formed in a position different from that of the meniscus pillar forming portion and recessed relative to the surroundings thereof;

a material supply unit which supplies the material to the applicator;

a first moving mechanism configured to move the position of the applicator relative to the surface to be coated along the surface to be coated;

a second moving mechanism configured to move the position of the applicator relative to the surface to be coated so that the meniscus pillar, which is formed between the meniscus pillar forming portion and the surface to be coated, is moved to the recess from the meniscus pillar forming portion; and a third moving mechanism configured to move the position of the applicator relatively toward and away from the surface to be coated;

wherein the applicator is rotatable through a predetermined angular range, and the second moving mechanism is configured to rotate the applicator relative to the surface to be coated of the object to be coated through the predetermined angular range, thereby locating the recess opposite the surface to be coated.

2. The coating apparatus of claim 1, wherein the meniscus pillar forming portion and the recess are arranged circumferentially relative to the applicator.

3. The coating apparatus of claim 2, wherein the applicator is in the form of a circular column having a circular shape perpendicular to an axis thereof.

4. The coating apparatus of claim 1, comprising a control unit, which controls the first and second moving mechanisms so that a first position of the surface to be coated and the meniscus pillar forming portion face each other in a direction where the meniscus pillar extends, controls the third moving mechanism so that the distance between the meniscus pillar forming portion and the surface to be coated is a first predetermined distance for the formation of the predetermined meniscus pillar, controls the material supply unit so that the material is supplied to the applicator, controls the first moving mechanism so that a second position of the surface to be coated and the meniscus pillar forming portion face each other in the direction where the meniscus pillar extends, and controls the second moving mechanism so that the recess faces the second position in the direction where the meniscus pillar extends after the second position and the meniscus pillar forming portion are located opposite each other in the direction where the meniscus pillar extends.

5. The coating apparatus of claim 4, wherein the control unit controls the first moving mechanism so that the first moving mechanism moves at a first movement speed within a range from a position where the meniscus pillar forming portion faces the first position in the direction where the meniscus pillar extends to a position where the meniscus pillar forming portion faces a speed-reduction position in the direction where the meniscus pillar extends and that the first moving mechanism moves at a second movement speed lower than the first movement speed after the speed-reduction position is passed as the position of the applicator relative to the surface to be coated is moved from the position where the meniscus pillar forming portion faces the first position in the direction where the meniscus pillar extends to a position where the meniscus pillar forming portion faces the second position in the direction where the meniscus pillar extends, the first and second movement speeds being set so that a thickness of the material applied in an area from the first position to the speed-reduction position is equal to a thickness of the material applied in an area from the speed-reduction position to the second position.

6. The coating apparatus of claim 1, comprising a suction mechanism configured to apply negative pressure to the recess.

7. The coating apparatus of claim 6, comprising a control unit, which controls the first and second moving mechanisms so that a first position of the surface to be coated and the meniscus pillar forming portion face each other in a direction where the meniscus pillar extends, controls the third moving mechanism so that the distance between the meniscus pillar forming portion and the surface to be coated is a first predetermined distance for the formation of the predetermined meniscus pillar, controls the material supply unit so that the material is supplied to the applicator, controls the first moving mechanism so that a second position of the surface to be coated and the meniscus pillar forming portion face each other in the direction where the meniscus pillar extends, controls the second moving mechanism so that the recess faces the second position in the direction where the meniscus pillar extends when the meniscus pillar forming portion faces the second position in the direction where the meniscus pillar extends, controls the third moving mechanism so that the position of the applicator relative to the surface to be coated is separated from a position where the predetermined meniscus pillar is formed between the meniscus pillar forming portion and the surface to be coated after the recess is located opposite the second position in the direction where the meniscus pillar extends, and drives the suction mechanism after the applicator is separated at a distance greater than the first predetermined distance from the surface to be coated.

8. The coating apparatus of claim 6, comprising a control unit, which controls the first and second moving mechanisms so that a first position of the surface to be coated and the meniscus pillar forming portion face each other in a direction where the meniscus pillar extends, controls the third moving mechanism so that the distance between the meniscus pillar forming portion and the surface to be coated is a first predetermined distance for the formation of the predetermined meniscus pillar, controls the material supply unit so that the material is supplied to the applicator, controls the first moving mechanism so that the meniscus pillar faces a second position of the surface to be coated in the direction where the meniscus pillar extends, controls the second moving mechanism so that the recess faces the second position in the direction where the meniscus pillar extends when the meniscus pillar forming portion faces the second position in the direction where the meniscus pillar extends, controls the third moving mechanism so that the distance in the direction where the meniscus pillar extends between the recess and the surface to be coated is a second predetermined distance corresponding to a thickness of the material to be obtained, and starts an operation of the suction mechanism when the distance in the direction where the meniscus pillar extends between the recess and the surface to be coated becomes the second predetermined distance.

9. A coating apparatus which applies a material to an object to be coated, comprising:

an applicator comprising a meniscus pillar forming portion configured to form a meniscus pillar of the material in conjunction with a surface to be coated of the object to be coated and a recess formed in a position different from that of the meniscus pillar forming portion and recessed relative to the surroundings thereof;

a material supply unit which supplies the material to the applicator;

a first moving mechanism configured to move the position of the applicator relative to the surface to be coated along the surface to be coated;

a second moving mechanism configured to move the position of the applicator relative to the surface to be coated so that the meniscus pillar, which is formed between the meniscus pillar forming portion and the surface to be coated, is between the surface to be coated and the recess; and a third moving mechanism configured to move the position of the applicator relatively toward and away from the surface to be coated, wherein the applicator is rotatable through a predetermined angular range, and the second moving mechanism is configured to rotate the applicator relative to the surface to be coated of the object to be coated through the predetermined angular range, thereby locating the recess opposite the surface to be coated.

10. The coating apparatus of claim 9, wherein the meniscus pillar forming portion and the recess are arranged circumferentially relative to the applicator.

11. The coating apparatus of claim 10, wherein the applicator is in the form of a circular column having a circular shape perpendicular to an axis thereof.

12. The coating apparatus of claim 9, comprising a control unit, which controls the first and second moving mechanisms so that a first position of the surface to be coated and the meniscus pillar forming portion face each other in a direction where the meniscus pillar extends, controls the third moving mechanism so that the distance between the meniscus pillar forming portion and the surface to be coated is a first predetermined distance for the formation of the predetermined meniscus pillar, controls the material supply unit so that the material is supplied to the applicator, controls the first moving mechanism so that a second position of the surface to be coated and the meniscus pillar forming portion face each other in the direction where the meniscus pillar extends, and controls the second moving mechanism so that the recess faces the second position in the direction where the meniscus pillar extends after the second position and the meniscus pillar forming portion are located opposite each other in the direction where the meniscus pillar extends.

13. The coating apparatus of claim 12, wherein the control unit controls the first moving mechanism so that the first moving mechanism moves at a first movement speed within a range from a position where the meniscus pillar forming portion faces the first position in the direction where the meniscus pillar extends to a position where the meniscus pillar forming portion faces a speed-reduction position in the direction where the meniscus pillar extends and that the first moving mechanism moves at a second movement speed lower than the first movement speed after the speed-reduction position is passed as the position of the applicator relative to the surface to be coated is moved from the position where the meniscus pillar forming portion faces the first position in the direction where the meniscus pillar extends to a position where the meniscus pillar forming portion faces the second position in the direction where the meniscus pillar extends, the first and second movement speeds being set so that a thickness of the material applied in an area from the first position to the speed-reduction position is equal to a thickness of the material applied in an area from the speed-reduction position to the second position.

* * * * *